US010025262B2

(12) United States Patent
Masuta et al.

(10) Patent No.: US 10,025,262 B2
(45) Date of Patent: Jul. 17, 2018

(54) SHEET FEEDING DEVICE ATTACHABLE TO AN IMAGE FORMING APPARATUS

(71) Applicant: KYOCERA Document Solutions Inc., Osaka (JP)

(72) Inventors: Noriko Masuta, Osaka (JP); Hideaki Doyo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/456,003

(22) Filed: Mar. 10, 2017

(65) Prior Publication Data

US 2017/0285559 A1 Oct. 5, 2017

(30) Foreign Application Priority Data

Mar. 30, 2016 (JP) ..... 2016-067536

(51) Int. Cl.
*G03G 21/16* (2006.01)

(52) U.S. Cl.
CPC ..... *G03G 21/1647* (2013.01); *G03G 21/1661* (2013.01)

(58) Field of Classification Search
CPC ..... G03G 21/1647; G03G 21/1661
See application file for complete search history.

(56) References Cited

U.S. PATENT DOCUMENTS 2,320,046 A * 5/1943 Notar ..... B60D 1/155 280/482
7,431,287 B2 * 10/2008 Hayashi ..... B65H 1/26 271/162
2004/0251589 A1 * 12/2004 Satoh ..... B65H 5/062 271/10.01
2008/0251996 A1 * 10/2008 Ubayashi ..... B65H 1/04 271/226
2010/0059093 A1 * 3/2010 Clark ..... A45B 11/00 135/16
2014/0212167 A1 * 7/2014 Agata ..... G03G 21/1647 399/107
2017/0131672 A1 * 5/2017 Ozawa ..... G03G 15/6529

FOREIGN PATENT DOCUMENTS

JP 2003-95453 A 4/2003

* cited by examiner

*Primary Examiner* — G. M. Hyder
(74) *Attorney, Agent, or Firm* — Stein IP, LLC

(57) ABSTRACT

An optional device of the present disclosure is attachable and detachable with respect to an image forming apparatus via a connection member fitted to a side face of a main body of the optional device. The connection member includes a shaft, a connector, and a lock member. The shaft is supported by the main body to be slidable in an axial direction. The connector is fixed to the shaft and coupled to the image forming apparatus. The lock member is capable or restricting movement of the shaft in the axial direction. A position of the connector is adjusted by releasing the restriction placed on the shaft by the lock member and then sliding the shaft in the axial direction.

7 Claims, 9 Drawing Sheets

SHEET FEEDING DEVICE ATTACHABLE TO AN IMAGE FORMING APPARATUS

INCORPORATION BY REFERENCE

This application is based upon and claims the benefit of priority from the corresponding Japanese Patent Application No. 2016-067536 filed on Mar. 30, 2016, the entire contents of which are incorporated herein by reference.

BACKGROUND

The present disclosure relates to an optional device attachably/detachably attached to a main body of an image forming apparatus.

For example, an optional device has been known which is configured to be retrofitted to an existing image forming apparatus, such as a copier, and includes a tray accommodating a large number of sheets and a sheet feeding unit.

This optional device is attached to an image forming apparatus, in such a manner that the sheet feeding unit is arranged opposite a sheet receiving port of the image forming apparatus. The sheet feeding unit feeds a sheet out of the tray into the sheet receiving port, and the sheet fed into the sheet receiving port is then conveyed to a sheet conveyance portion. Thus, when there is not enough space for a large number of sheets in the image forming apparatus, sheets can be fed from the retrofitted optional device into the image forming apparatus.

The optional device is further provided with a connection member arranged on an opposing face of the optional device, the opposing face arranged opposite to the image forming apparatus. The connection member has an engagement hole to be engaged with a projection provided on an opposing face of the image forming apparatus, the opposing face arranged opposite to the opposing face of the optional device. Thereby, it is possible to attach the optional device to the image forming apparatus easily.

SUMMARY

According to an aspect of the present disclosure, an optional device is attachable and detachable with respect to an image forming apparatus via a connection member fitted to a side face of a main body of the optional device. The connection member includes a shaft, a connector, and a lock member. The shaft is supported by the main body of the optional device to be slidable in an axial direction. The connector is fixed to the shaft and coupled to the image forming apparatus. The lock member can restrict movement of the shaft in the axial direction. The position of the connector is adjusted by releasing the restriction placed on the shaft by the lock member and then sliding the shaft in the axial direction.

Further features and specific advantages of the present disclosure will become apparent from the following descriptions of preferred embodiments.

DETAILED DESCRIPTION

Figure 1:
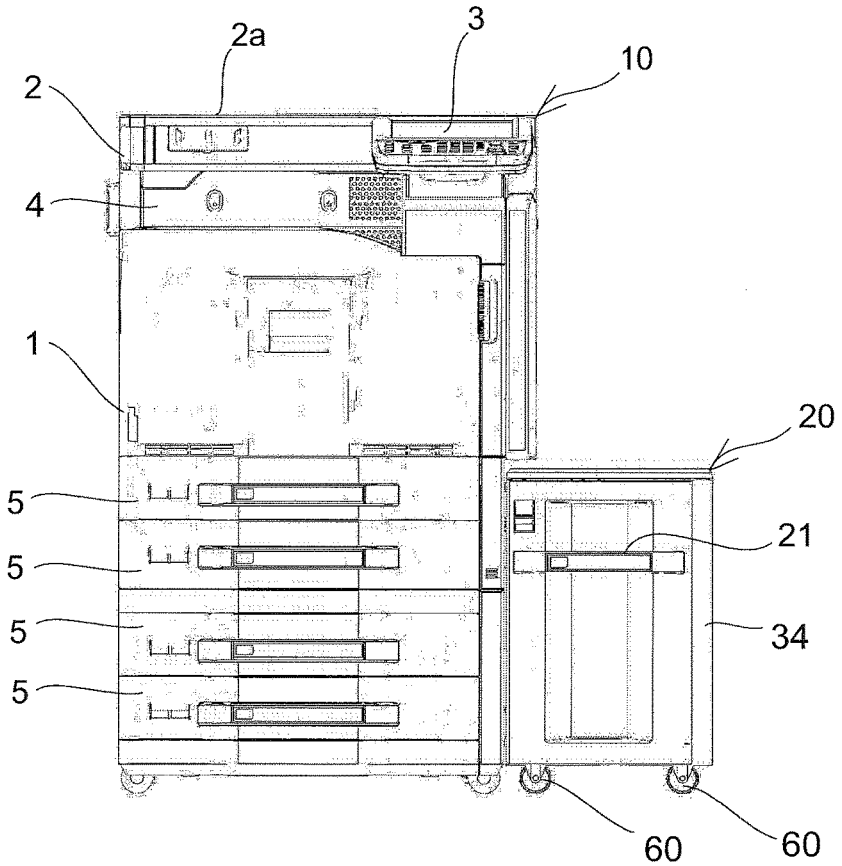
FIG. 1 is a front view illustrating a state where a sheet feeding device according to an embodiment of the present disclosure is arranged beside an image forming apparatus.

An embodiment of the present disclosure will be described below with reference to the accompanying drawings. FIG. 1 is a front view illustrating a state where a sheet feeding device 20 according to an embodiment of the present disclosure is arranged beside an image forming apparatus 10. The image forming apparatus 10 is provided with an image forming apparatus main body 1 (hereinafter, apparatus main body 1) and an image reading device 2 disposed above the apparatus main body 1. Inside the image reading device 2, an image reader is provided. The image reader reads image information from a document placed on a contact glass 2*a*.

The image reader includes a scanning optical system, a condenser lens, a CCD sensor, and the like (none of which is illustrated), and reads an image of a document to convert the read image into image data. The scanning optical system incorporates a scanner lamp which illuminates a document for copying, and a mirror which changes an optical path of light reflected from the document. The condenser lens collects light reflected from the document to form an image. The CCD sensor converts light representing the formed image into an electric signal.

In a front part of the image reading device 2, there is provided an operation panel 3, which has operation buttons and a display portion. Above the image reading device 2, a platen (not shown) is openably/closably provided which holds a document placed on the contact glass 2*a*.

Between the image reading device 2 and the apparatus main body 1, there is provided an in-body sheet discharge space 4, which is wide open leftward and frontward.

On a front face of the apparatus main body 1, there are provided a plurality of sheet feeding cassettes 5, which accommodate sheets therein and are attachable and detachable with respect to the apparatus main body 1.

Inside the apparatus main body 1, there are provided an image forming portion, a fixing portion, a sheet conveyance portion, and the like, of which none is illustrated. The image forming portion forms an image on a sheet fed thereto, by transferring onto the sheet a toner image formed based on image data read by the image reading device 2. The image forming portion includes a photosensitive drum, a charging unit, an exposure unit, a developing unit, a transfer roller, a cleaning blade, and the like.

The photosensitive drum carries an electrostatic latent image. The charging unit electrically charges a surface of the photosensitive drum. The exposure unit forms an electrostatic latent image corresponding to a document image on the surface of the photosensitive drum by means of a laser beam or the like. The developing unit forms a toner image by causing a developer to adhere to the electrostatic latent image formed on the photosensitive drum. The transfer roller transfers the toner image onto the sheet. The cleaning blade removes residual toner remaining on the surface of the photosensitive drum.

The fixing portion applies heat and pressure to the sheet onto which the toner image has been transferred, and thereby fixes the toner image on the sheet. The sheet conveyance portion extends upward along a right side face of the apparatus main body 1, and conveys a sheet from each of the sheet feeding cassettes 5 to the image forming portion.

Further, a sheet feeding device (an optional device) 20 is arranged beside and attached to the image forming apparatus 10. The sheet feeding device 20 has a housing 34 and a tray 21 inside the housing 34, which is formed in a substantially rectangular parallelepiped shape. The tray 21 is for stacking thereon sheets to be fed to the image forming portion, so that the sheet feeding device 20 can accommodate a large amount, such as several thousand, of sheets. The housing 34 has casters 60 fitted to a bottom face of the housing 34, one at each corner of the bottom face, so that the sheet feeding device 20 can be moved easily.

FIG. 2 to FIG. 5 are perspective views of a caster 60, which includes a wheel 61, a main body portion 62, a bolt portion 63, a nut 64, and a support member 65. The main body portion 62 rotatably supports a rotary shaft 61*a* of the wheel 61. The bolt portion 63 is fixed to an upper part of the main body portion 62, and extends in an up-down direction. The nut 64 is rotatably fitted to the bolt portion 63. The support member 65 is placed on the nut 64.

The main body portion 62 has a pair of side face portions 62*a*, which function as a bearing for the rotary shaft 61*a*, and a top face portion 62*b*, which connects the pair of side face portions 62*a* to each other, such that the main body portion 62 is substantially U-shaped. To an upper surface of the top face portion 62*b*, a nut portion 62*c* is fixed by welding or the like. The nut portion 62*c* has its inner surface threaded.

The bolt portion 63 includes a threaded part 63*a* and a non-threaded part 63*b*. The threaded part 63*a* has a thread formed thereon, and the non-threaded part 63*b*, which is arranged above the threaded part 63*a*, does not have a thread formed thereon. A lower end part of the threaded part 63*a* of the bolt portion 63 is fastened and fixed to the nut portion 62*c* of the main body portion 62. Here, no through hole is formed in the top face portion 62*b* of the main body portion 62, and the bolt portion 63 is firmly fixed to the main body portion 62 by being screwed into the nut portion 62*c* until it comes into contact with the top face portion 62*b* of the main body portion 62.

Figure 2:
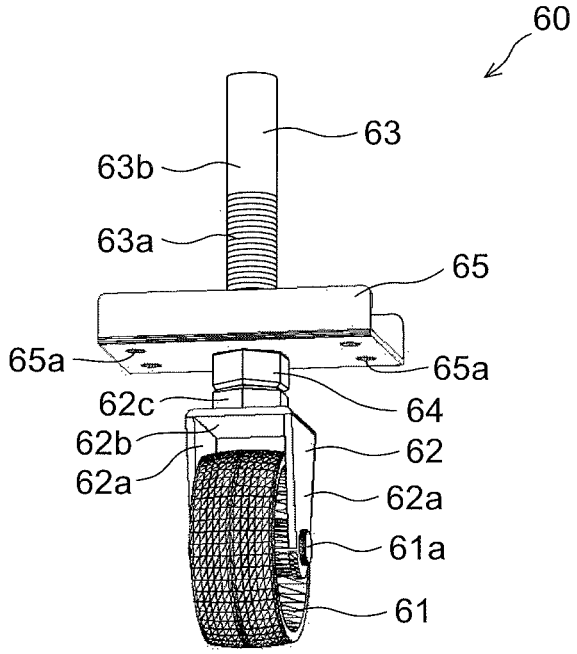
FIG. 2 is a perspective view illustrating a structure of a caster of the sheet feeding device according to the embodiment of the present disclosure as viewed from below.
Figure 3:
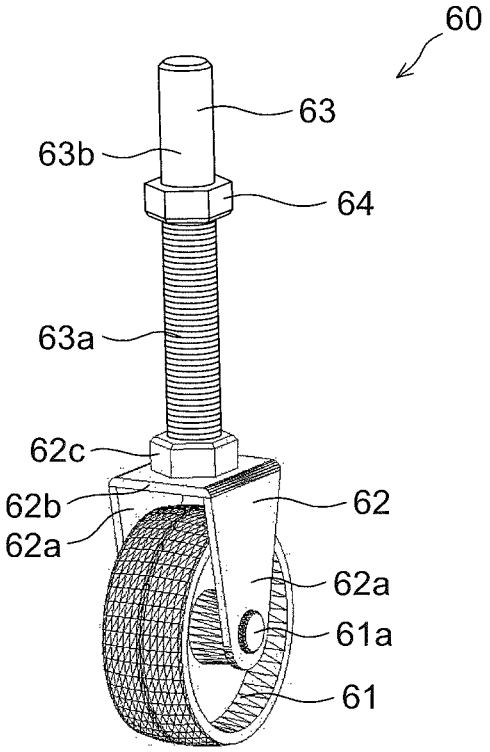
FIG. 3 is a perspective view illustrating the structure of the caster of the sheet feeding device according to the embodiment of the present disclosure excluding a support member as viewed from above, illustrating a state where a nut is arranged at an uppermost position in a predetermined range.
Figure 4:
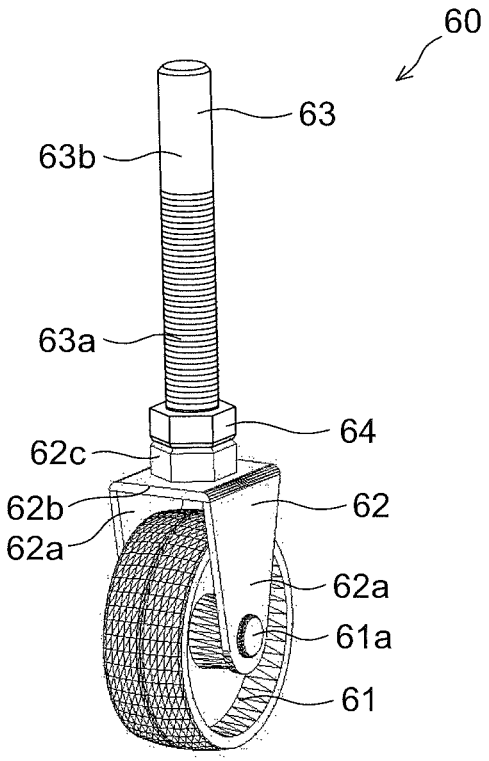
FIG. 4 is a perspective view illustrating the structure of the caster of the sheet feeding device according to the embodiment of the present disclosure excluding the support member, as viewed from above, illustrating a state where the nut is arranged at a lowermost position in the predetermined range.
Figure 5:
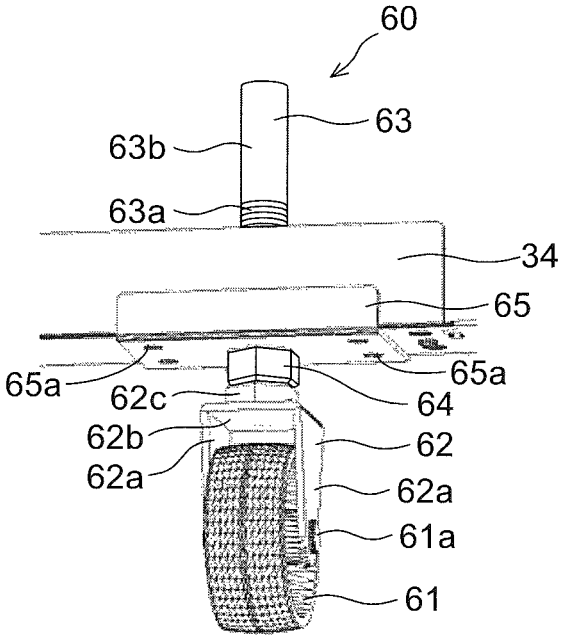
FIG. 5 is a perspective view illustrating the caster of the sheet feeding device according to the embodiment of the present disclosure as viewed from below, illustrating a state where a lower frame of a main body of the sheet feeding device is placed on the support member of the caster.

The support member 65 is formed by bending sheet metal into a U-shape (see FIG. 2). In a center part of the support member 65, there is formed a through hole (not shown) which is large enough for the threaded part 63*a* and the non-threaded part 63*b* of the bolt portion 63 to pass therethrough, but is too small for the nut 64 to pass therethrough. Further, in the support member 65, there are formed a plurality of fitting holes 65*a* for fixing the support member 65 to the housing 34 of the sheet feeding device 20 (see FIG. 5). Here, the support member 65 is not fixed to either the bolt portion 63 or the nut 64. This allows the wheel 61 to revolve with respect to the sheet feeding device 20 in a state where the support member 65 is fixed to the housing 34.

The nut 64 supports the sheet feeding device 20 via the support member 65, and is movable in the up-down direction along the bolt portion 63 by being turned about the bolt portion 63. Further, the nut 64 is movable in the up-down direction in a range (a predetermined range) from an uppermost part of the threaded part 63*a* of the bolt portion 63 to a position where the nut 64 comes into contact with the nut portion 62*c* of the main body portion 62 (see FIG. 3, FIG. 4). Thus, by arranging the nut 64 between the uppermost part and a lowermost part, it is possible to freely set the height of the sheet feeding device 20 in the up-down direction.

Figure 6:
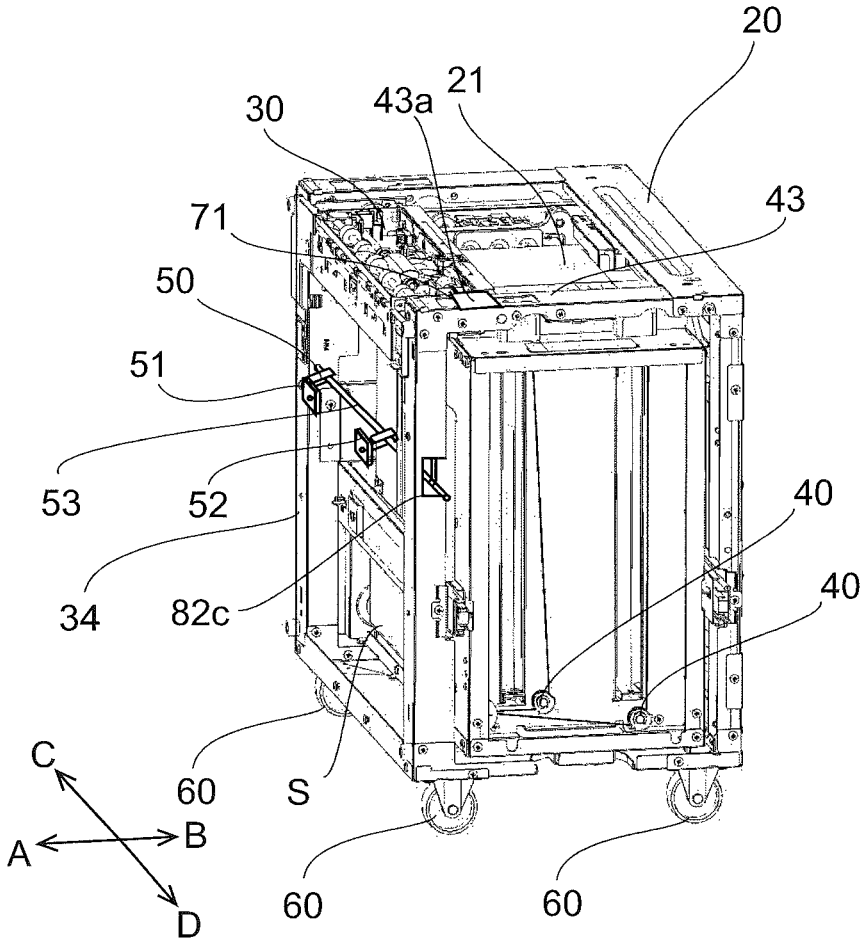
FIG. 6 is a perspective view illustrating a structure of an image-forming-apparatus attaching face of the sheet feeding device according to the embodiment of the present disclosure.
Figure 7:
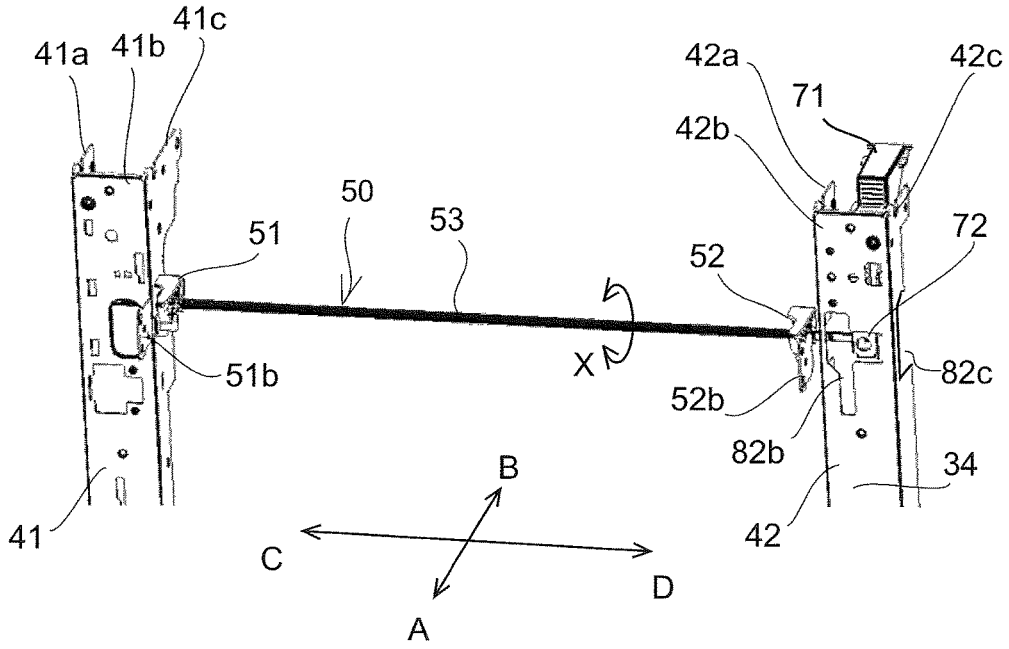
FIG. 7 is a perspective view illustrating, in an enlarged manner, part of a connection member of the sheet feeding device according to the embodiment of the present disclosure.
Figure 8:
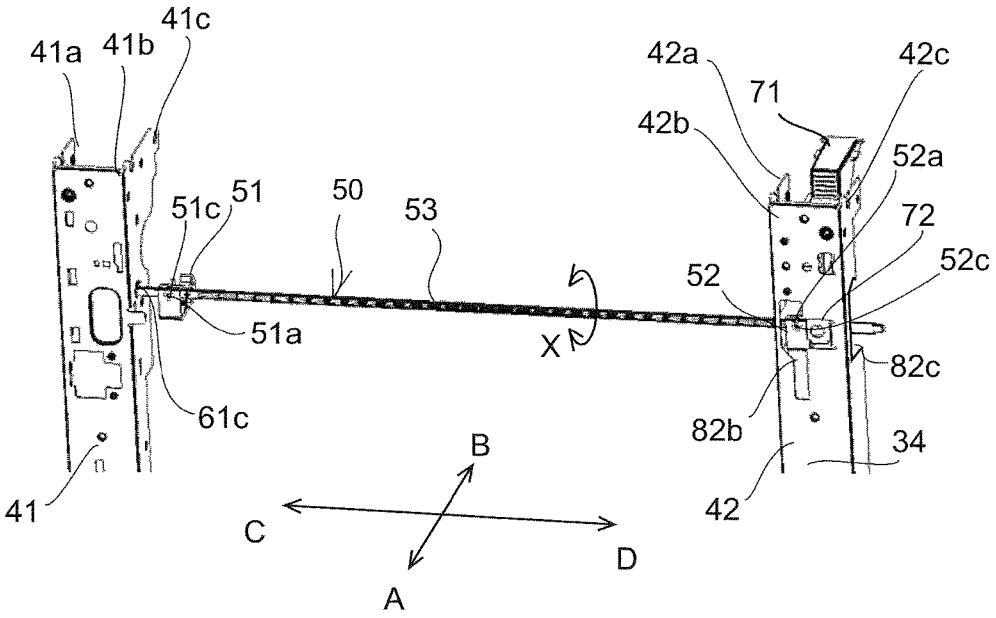
FIG. 8 is a perspective view illustrating, in an enlarged manner, part of the connection member of the sheet feeding device according to the embodiment of the present disclosure.
Figure 9:
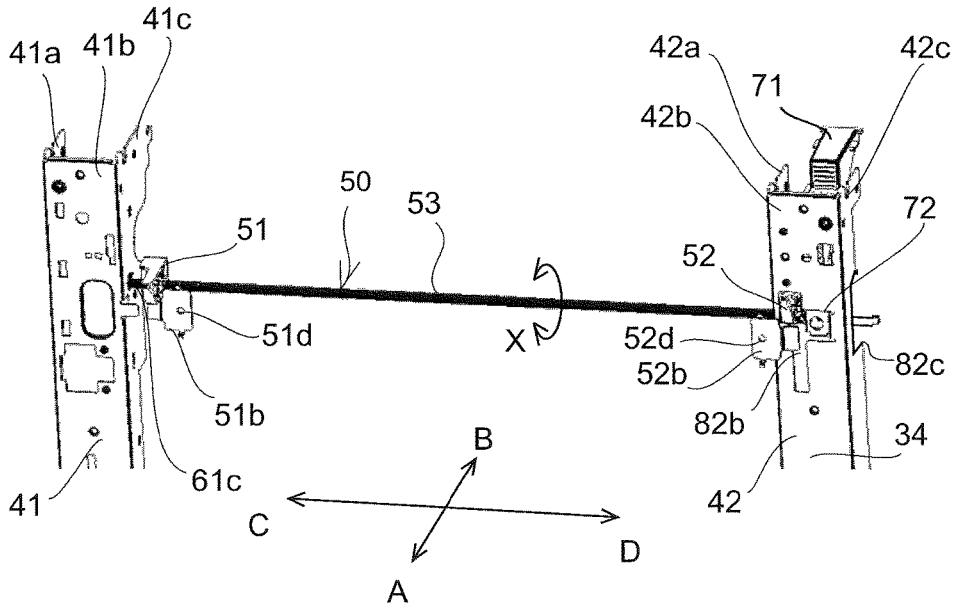
FIG. 9 is a perspective view illustrating, in an enlarged manner, part of the connection member of the sheet feeding device according to the embodiment of the present disclosure.

FIG. 6 is a perspective view of the sheet feeding device 20, and the face of the sheet feeding device 20 that faces the image forming apparatus 10 is the left-side face in FIG. 6. FIG. 7 to FIG. 9 are perspective views illustrating, in an enlarged manner, the connection member 50 of the sheet feeding device 20. The sheet feeding device 20 is retrofitted to the image forming apparatus 10, by being mechanically coupled to the image forming apparatus 10 via the connection member 50 so as not to be separated from the image forming apparatus 10. Although not illustrated, along with the mechanical coupling, the sheet feeding device 20 is electrically connected to the image forming apparatus 10 via a flat cable or the like.

For maintenance or to remove a sheet jammed between the sheet feeding device 20 and the image forming apparatus 10, it is possible to release the mechanical coupling and the electric connection between the sheet feeding device 20 and the image forming apparatus 10 to separate them from each other.

The sheet feeding device 20 includes the tray 21, a sheet feeding unit 30, and an elevator mechanism 40, which are arranged inside the housing 34. When the sheet feeding device 20 is attached to the image forming apparatus 10, the sheet feeding unit 30 is arranged opposite to a sheet receiving port (not shown) of the image forming apparatus 10. This allows the sheet feeding unit 30 to feed sheets on the tray 21, which is moved up and down by the elevator mechanism 40, out of the tray 21 one by one to the sheet receiving port. A sheet fed into the sheet receiving port is then conveyed to the sheet conveyance portion of the image forming apparatus 10.

The housing 34 has first and second frames 41 and 42, which are arranged on left and right sides on the opposing face of the sheet feeding device 20 arranged opposite to the image forming apparatus 10, and which extend vertically. The housing 34 has a space S between the first and second frames 41 and 42, the space S extending in a direction (a direction B) toward inside of the housing 34. The connection member 50 is provided inside the space S, below the sheet feeding unit 30. The connection member 50 moves in a left-right direction (C-D direction) in the space S.

Specifically, the connection member 50 includes a shaft 53, which is rod shaped and extends in the left-right direction (C-D direction), and first and second connectors 51 and 52, which are fixed to the shaft 53. The first and second connectors 51 and 52 are each a substantially rod shape member formed of a resin material by molding. At one end side of each of the first and second connectors 51 and 52, there is formed a through hole which the shaft 53 fits through, and also have screw holes 51*a* and 52*a*, respectively, via which the first and second connectors 51 and 52 are fastened to the shaft 53 with screws 51*c* and 52*c* (see FIG. 8). Further, on the other end side of each of the first and second connectors 51 and 52, there is formed a wedge-shaped projection projecting toward the shaft 53.

The shaft 53 penetrates through the first and second connectors 51 and 52, and by unfastening the screws 51*c* and 52*c* (see FIG. 8) inserted into the screw holes 51*a* and 52*a*, it is possible to allow the first and second connectors 51 and 52 to move in the left-right direction (C-D direction) along the shaft 53. Further, the shaft 53 is provided with predetermined screw holes (not shown) at predetermined intervals in the left-right direction (C-D direction). With this configuration, it is possible to move the first and second connectors 51 and 52 to predetermined positions and then tighten the screws 51*c* and 52*c* to fix the first and second connectors 51 and 52 to the shaft 53. Thereby, it is possible to adjust the interval between the first and second connectors 51 and 52 in the left-right direction (C-D direction) in accordance with coupling positions on the side of the image forming apparatus 10.

Further, the image forming apparatus 10 is provided with first and second fitting plates 51*b* and 52*b* corresponding to the first and second connectors 51 and 52, respectively. The first and second fitting plates 51*b* and 52*b*, which are each a member formed by processing sheet metal, are provided with screw holes 51*d* and 52*d*, respectively, via which to fasten them to the image forming apparatus 10 with screws (see FIG. 9). Further, in the first and second fitting plates 51*b* and 52*b*, there are formed edge portions with which the wedge-shaped projections of the first and second connectors 51 and 52 engage.

The first frame 41 is formed by bending sheet metal into a U-shape in top view, with a plate-shaped first front face portion 41*b* extending in the up-down direction, and with a first left side face portion 41*a* and a first right side face portion 41*c* on both sides of the first front face portion 41*b*. Likewise, the second frame 42 is formed by bending sheet metal into a U-shape, in top view, with a plate-shaped second front face portion 42*b* extending in the up-down direction, and with a second left side face portion 42*a* and a second right side face portion 42*c* on both sides of the second front face portion 42*b*.

Further, the first frame 41 has a first left insertion hole (not shown) formed in the first left side face portion 41*a*, and a first right insertion hole 61*c* formed in the first right side face portion 41*c*. The first left insertion hole and the first right insertion hole 61*c* are arranged opposite to each other, each having a diameter that is slightly larger than that of the shaft 53. Thereby, the first left insertion hole and the first right insertion hole 61*c* allow the shaft 53 to slide in the left-right direction (C-D direction), and support the shaft 53 in such a manner that the shaft 53 is rotatable in a circumferential direction (an X direction).

Further the second frame 42 has recessed portions 82*c* formed one in each of the second left side face portion 42*a* and the second right side face portion 42*c*. The recessed portion of the second left side face portion 42*a* is not illustrated. The faces in which the recessed portions 82*c* are formed are both perpendicular to the opposing face, which is arranged facing the image forming apparatus 10. Specifically, the second front face portion 42*b* connects to each other edges of the second left and right side face portions 42*a* and 42*c* that are located on a side (side A) close to the opposing face, and the recessed portions 82*c* are formed to open in edges of the second left and right side face portions 42*a* and 42*c* that are located on a side (side B) away from the opposing face.

Thereby, it is possible to pass the second connector 52 through the recessed portions 82*c* formed in the second left and right side face portions 42*a* and 42*c* by moving the shaft 53 rightward (in the D direction) while turning it in the circumferential direction (X direction). Thereby, it is possible to arrange the second connector 52 to the right (on the D-direction side) of the second right side face portion 42*c*.

Although the second front face portion 42*b* is provided on the opposing face side (side A), it may be provided on the side (side B) away from the opposing face. In this case, the second front face portion 42*b* connects to each other the edges of the second left and right side face portions 42*a* and 42*c* that are located on the side (side B) away from the opposing face, and the recessed portions 82*c* are formed to open in the edges of the second left and right side face portions 42*a* and 42*c* that are located on the side (side A) close to the opposing face.

Thereby, it is possible to pass the second connector 52 through the recessed portions 82*c* by moving the shaft 53 rightward (in the D direction) without turning it in the circumferential direction (X direction). Thereby, it is possible to arrange the second connector 52 to the right (on the D-direction side) of the second right side face portion 42*c*.

Further, the second front face portion 42*b* of the second frame 42 is provided with a through hole 82*b*, and by rotating the second connector 52, it is possible to pull the second connector 52 (in the A direction) out of the second front face portion 42*b* via the through hole 82*b* (see FIG. 9).

Further, inside the second frame 42, there is provided a lock member 72, which is capable of supporting the shaft 53 while restricting movement of the shaft 53 in the circumferential direction (X direction) and in the left-right direction (C-D direction). Further, the lock member 72 is coupled to a lever 71, which is provided at an upper part of the second frame 42. By means of the lever 71, it is possible to cause the lock member 72 to restrict the movement of the shaft 53 or to release the restriction. This helps further improve convenience in attaching the sheet feeding device 20 to the image forming apparatus 10.

Figure 10:
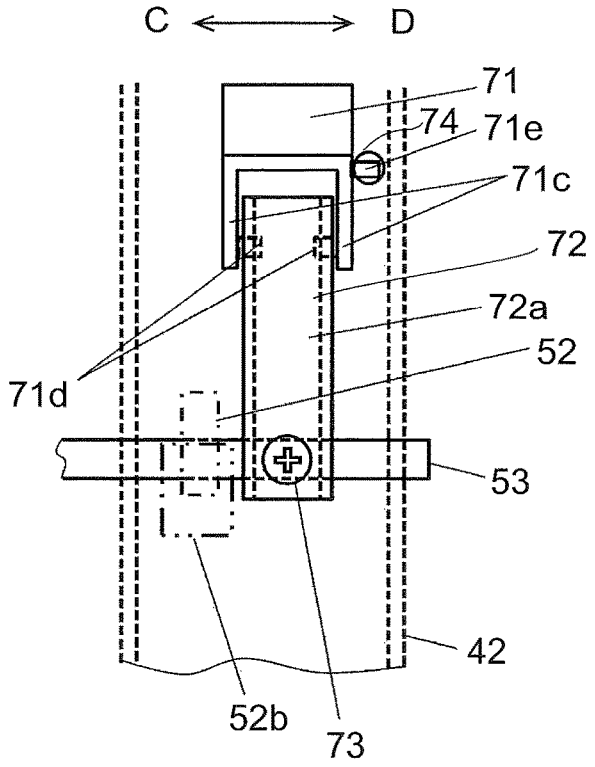
FIG. 10 is an explanatory diagram illustrating configurations of a lever and a lock member of the sheet feeding device according to the embodiment of the present disclosure.
Figure 11:
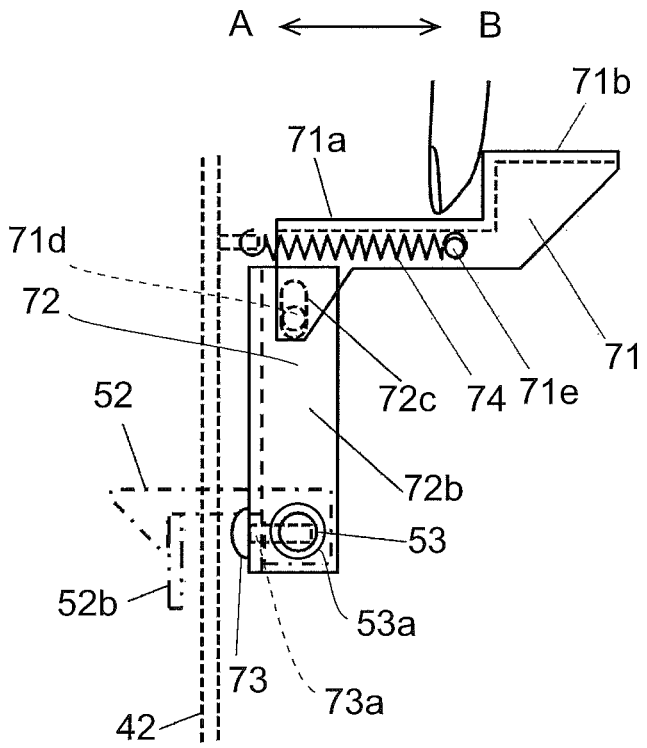
FIG. 11 is an explanatory diagram illustrating configurations of the lever and the lock member of the sheet feeding device according to an embodiment of the present disclosure.

FIG. 10 and FIG. 11 are explanatory diagrams illustrating configurations of the lever 71 and the lock member 72 of the sheet feeding device 20. As illustrated in FIG. 10 and FIG. 11, the second frame 42 is provided with the lock member 72. The lock member 72 is a member fixed to the shaft 53, and is formed by bending sheet metal into a U-shape in top view, with a base 72*a*, having a rectangular shape elongated in the up-down direction, and with side faces 72*b*, extending inwardly (in the B direction) from both left and right side edges of the base 72*a*.

In lower parts of the side faces 72*b*, there are formed through holes 53*a*, through which the shaft 53 is inserted. In the base 72*a*, there is formed a through hole 73*a*, through which a threaded part of a fastening screw 73 is inserted to be screwed into any of the screw holes (not shown) formed in the shaft 53. Further, above the through holes 53*a* of the side faces 72*b*, there are formed long holes 72*c*, which are elongated in the up-down direction. By being integrally fixed, by means of the fastening screw 73, to the shaft 53, which has been inserted through the lock member 72, the lock member 72 is supported to be rotatable with the shaft 53 as a rotation shaft.

The lever 71 is fitted in an opening 43*a* of an upper frame 43 (see FIG. 6) of the sheet feeding device 20 to be slidable in a direction (the A-B direction) perpendicular to a direction (the C-D direction) in which the shaft 53 extends. Further, a top face of the lever 71 is exposed outside via the opening 43*a*. The lever 71 is a member formed by molding an elastic resin material. As viewed from above, the lever 71 is formed in a rectangular shaper elongated in a direction (A-B direction) perpendicular to the direction in which the shaft 53 extends.

The top face of the lever 71 has a stepwise surface with a retracted portion 71*a* located close to the shaft 53 and an operation portion 71*b* located away from the shaft 53. The retracted portion 71*a* and the operation portion 71*b* each have a flat surface. Further, the retracted portion 71*a* is arranged below the operation portion 71*b*, and is located below a top face of the upper frame 43. On the other hand, the operation portion 71*b* is arranged at substantially the same height as the top face of the upper frame 43.

The lever 71 further includes plate-shaped leg portions 71*c* facing each other and extending downward from shaft-53-side parts of edges of the retracted portion 71*a* in the left-right direction (the C-D direction). Cylindrical coupling projections 71*d* are formed one on each of opposing surfaces of the leg portions 71*c*, and the coupling projections 71*d* are inserted one into each of the long holes 72*c* of the lock member 72. Thereby, the lever 71 and the lock member 72 are coupled to each other.

Further, on a front-side (D-direction) one of side surfaces of the retracted portion 71*a*, at a position close to the operation portion 71*b*, there is formed an engagement projection 71*e*. Further, one end of a tension spring 74 is hooked on the engagement projection 71*e*, the tension spring 74 extending in a direction (the B direction) perpendicular to the direction (the C-D direction) in which the shaft 53 extends. The other end of the tension spring 74 is hooked on a part of the second frame 42, such that the lever 71 is constantly biased toward the second frame 42 (in the A direction).

The lever 71 is coupled to the lock member 72 by the engagement between the coupling projections 71*d* and the long holes 72*c*. As a result, the shaft 53, which is integrally fixed to the lock member 72, is constantly biased in a counter-clockwise direction in FIG. 11 by biasing force of the tension spring 74. Thereby, the movement of the shaft 53 in the circumferential direction (the X direction) is restricted by spring force of the lock member 72. When the sheet feeding device 20 is coupled to the image forming apparatus 10, the wedge-shaped projections of the first and second connectors 51 and 52, both fixed to the shaft 53, are engaged with the edge portions of the first and second fitting plates 51*b* and 52*b*, and constantly biased in a direction for pressing the edge portions.

On the other hand, to separate the sheet feeding device 20 from the image forming apparatus 10 for jam disposal, for example, the user inserts his or her finger into the retracted portion 71*a* of the lever 71 to slide the retracted portion 71*a* in the B direction against the biasing force of the tension spring 74. Thereby, the lock member 72 rotates in the clockwise direction in FIG. 11 together with the shaft as a rotation shaft. As a result, the wedge-shaped projections of the first and second connectors 51 and 52 retract upward from the edge portions of the first and second fitting plates 51*b* and 52*b*, so that their engagement is released, making it possible to move the sheet feeding device 20 in a direction (the B direction) for moving the sheet feeding device 20 away from a side face of the image forming apparatus 10.

Next, a description will be given of movement of the connection member 50 in attaching the sheet feeding device 20 to an image forming apparatus 10 in which a sheet feeding portion is arranged at a different position. First, the nut 64 of each of the casters 60 is moved in the up-down direction to adjust the height of the sheet feeding device 20 in the up-down direction.

Next, the fastening screw 73 is removed, then the restriction placed on the movement of the shaft 53 in the left-right direction is released by operating the lever 71, and then the shaft 53 is moved to slide in the left-right direction (the C-D direction) to be aligned to the fitting plates 51*b* and 52*b* of the image forming apparatus 10.

Next, the first and second connectors 51 and 52 are rotated to turn the shaft 53 in the circumferential direction (the X direction) so as to locate the screw holes 51*a* and 52*a* parallel with respect to the opposing face of the image forming apparatus 10 (see FIG. 9). Next, the screws 51*c* and 52*c* are untightened to move the first and second connectors 51 and 52 until they are aligned with the first and second fitting plates 51*b* and 52*b* of the image forming apparatus 10, and then the first and second connectors 51 and 52 are screw-fastened to the first and second fitting plates 51*b* and 52*b*. Lastly, the lock member 72 and the shaft 53 are fixed to each other with the fastening screw 73, so that it is possible, by operating the lever 71, to cause the lock member 72 to restrict the movement of the shaft 53. Thereby, it is possible to easily detach and attach the sheet feeding device 20 with respect to the image forming apparatus 10.

Here, by sliding the shaft 53 in the left-right direction (the C-D direction), the second connector 52 can be arranged to the left (on the C-direction side) of the second left side face portion 42*a*, between the second left side face portion 42*a* and the second right side face portion 42*c*, or to the right (on the D-direction side) of the second right side face portion 42*c*.

In a case where the second connector 52 is arranged between the second left side face portion 42*a* and the second right side face portion 42*c*, it is possible to pull the second connector 52 (in the A direction) out of the second front face portion 42*b* via the through hole 82*b* for coupling (see FIG. 9).

In a case where the second connector 52 is arranged to the right (in the D direction) of the second right side face portion 42*c*, it is possible to arrange the shaft 53 to the right (in the D direction) of the second frame 42 by sliding the shaft 53 while rotating it in the circumferential direction (the X direction).

According to the embodiment of the present disclosure, the sheet feeding device 20 as an optional device can be attached to image forming apparatuses of various specifications by adjusting the position of the sheet feeding device 20 in the left-right direction by moving the shaft 53 in the left-right direction (the C-D direction) in the connection member 50 of the sheet feeding device 20. Further, the height of the sheet feeding device 20 in the up-down direction can be adjusted by moving the nut 64 of the caster 60 in the up-down direction. Thereby, by easily changing the positions of the first and second connectors 51 and 52, it is possible to improve convenience in attachment, while controlling increase in the number of components of the optional device 20.

Further, it is also possible to untighten the screws 51*c* and 52*c* (see FIG. 8) to adjust the interval between the first and second connectors 51 and 52 in the left-right direction (the C-D direction) in accordance with the coupling positions on the image forming apparatus 10.

Although the embodiment of the present disclosure has dealt with an example where the sheet feeding device 20 is applied as an optional device, the present disclosure is applicable to various optional devices. For example, a sheet post-processing device is applicable as an optional device. A sheet post-processing device can be attached to the image forming apparatus 10 so as to be located beside the image forming apparatus 10, on a side of the image forming apparatus 10 opposite from the side where the sheet feeding device 20 is arranged. The sheet post-processing device is capable of automatically performing processing such as stapling processing and punching processing with respect to a comparatively large number of sheets each having an image transferred thereon by the image forming apparatus 10.

The sheet post-processing device, too, can be attached to image forming apparatuses of various specifications by adjusting the position of the sheet post-processing device in the up-down direction by moving a shaft in a connection member of the sheet post-processing device in a front-back direction (the C-D direction) and moving a nut portion of each caster in the up-down direction, whereby it is possible to improve convenience in attachment, while controlling increase in the number of components of the sheet post-processing device.

What is claimed is:

1. A sheet feeding device which is arranged beside and attached to an image forming apparatus including an image forming portion, and which accommodates a sheet and feeds the sheet to the image forming portion to have an image formed on the sheet, the sheet feeding device comprising:

a main body; and a connection member which is fitted to an opposing face of the main body, the opposing face disposed adjacent to the image forming apparatus, and which is mechanically coupled to a side face of the image forming apparatus and restricts movement in a direction away from the side face of the image forming apparatus, wherein the connection member includes a shaft supported by the main body of the sheet feeding device to be slidable in an axial direction, a connector fixed to the shaft and coupled to the image forming apparatus, and a lock member capable of fixing and unfixing the shaft at a plurality of positions in the axial direction, a lever which is coupled to the lock member to restrict movement of the shaft in the axial direction, and which is operated in uncoupling the connector from the image forming apparatus, and a fixing position of the connector is adjusted by unfixing the lock member from the shaft and then sliding the shaft in the axial direction.

2. The sheet feeding device according to claim 1, wherein the main body of the sheet feeding device includes a first frame and a second frame which extend in an up-down direction and are arranged on left and right sides of the opposing face of the sheet feeding device, the opposing face facing the image forming apparatus, the first frame or the second frame has recessed portions through which the shaft is inserted, and the connector passes through the recessed portions when the shaft is slid in the axial direction.

3. The sheet feeding device according to claim 2, wherein the first frame and the second frame are each formed in a U-shape with a pair of side face portions perpendicular to the opposing face and a front face portion connecting the side face portions to each other, the recessed portions are formed in the pair of side face portions, and the connector passes through the recessed portions when the shaft is slid in the axial direction.

4. The sheet feeding device according to claim 3, wherein the shaft is supported by the main body of the sheet feeding device to be rotatable about an axis of the shaft, the front face portion connects edges of the pair of side face portions to each other, the edges being located on a side close to the opposing face, the recessed portions are formed to be open in edges of the side face portions, the edges being located on a side away from the opposing face, and the connector is caused to pass through the recessed portions by the shaft being slid in the axial direction while the shaft is rotated about the axis of the shaft.

5. The sheet feeding device according to claim 1, wherein the fixing position of the connector, at which the connector is fixed to the shaft, is variable in the axial direction.

6. The sheet feeding device according to claim 1, further comprising a caster which movably supports the main body of the sheet feeding device, wherein the caster includes a wheel, a main body portion which rotatably supports a rotary shaft of the wheel, a bolt portion which is fixed to an upper part of the main body portion and extends in the up-down direction, and a nut which is rotatably fitted to the bolt portion to be movable in the up-down direction, a threaded part is formed in a part of the bolt portion, and the nut is movable in the up-down direction within a predetermined range in the threaded part, and the nut is arranged between uppermost and lowermost parts of the predetermined range to support the main body of the sheet feeding device.

7. The sheet feeding device according to claim 6, wherein the bolt portion includes the threaded part and a non-threaded part which is arranged above the threaded part, and a lower end part of the threaded part is fixed to the main body.

* * * * *